United States Patent [19]

Feher et al.

[11] Patent Number: 4,684,191

[45] Date of Patent: Aug. 4, 1987

[54] ELECTRICAL TERMINAL AND ELECTRICAL CONNECTOR ASSEMBLY

[75] Inventors: Michael S. Feher, Steelton; Charles H. Weidler, Lancaster; James H. Wise, Harrisburg, all of Pa.

[73] Assignee: AMP Incorporated, Harrisburg, Pa.

[21] Appl. No.: 880,231

[22] Filed: Jun. 30, 1986

[51] Int. Cl.[4] ..... H01R 13/64; H01R 13/20

[52] U.S. Cl. ..... 439/246; 439/851; 439/883

[58] Field of Search ..... 174/71 B; 339/64 R, 339/64 M, 65, 75 R, 75 M, 22 B, 258 R, 258 F, 258 P, 258 S, 262 R, 262 F, 262 P, 262 RR, 263 R, 277 R, 277 C; 361/342, 378

[56] References Cited

U.S. PATENT DOCUMENTS 1,092,430 4/1914 Cole ..... 339/262 F 3,355,695 11/1967 Overesch ..... 339/277 R

*Primary Examiner*—Gil Weidenfeld

*Assistant Examiner*—Gary F. Paumen

*Attorney, Agent, or Firm*—T. G. Terrell

[57] ABSTRACT

An electrical terminal for making connection to a ring tongue comprises two metal plates each having a central aperture and a semicircular shaft segment having a portion outstanding from the plate and a portion forming part of the periphery of the aperture. The shaft segment of one plate is force fitted into the aperture of the other plate, with the ring tongue surrounding the two shaft segments, so that the two shaft segments cooperate to provide a hollow shaft, contact springs on plates cooperating to provide a receptacle for a bus bar. The outer faces of the shaft segments and the walls of the apertures are complimentarily tapered to enable the force fit. In use, a fastener is passed through the hollow shaft to secure the terminal to a guide fork, the assembly so formed being mounted on a slideway secured to a rack mounted electrical module to be connected to the bus bar.

15 Claims, 5 Drawing Figures

ELECTRICAL TERMINAL AND ELECTRICAL CONNECTOR ASSEMBLY

This application is related to application Ser. No. 880,238, filed June 30, 1986.

This invention relates to an electrical terminal, and to an electrical connector assembly for mating with a bus bar.

When an electrical power supply module which is slidable in a rack frame, is to be connected to a bus bar in the frame, for supplying power to the bus bar, it is customary for an electrical lead extending from the module to be secured to the bus bar by means of a bolt in order to connect the circuitry of the module to the bus bar. The disconnection of the module from the bus bar, in order to allow repair work to be carried out on the module, and the subsequent reconnection of the module to the bus bar are, therefore, time consuming, and further, the connection between the lead and the bus bar is subject to temperature cycling by reason of the heat generated by the module, so as to loosen the bolt as a result of differential expansion between the metal of the bolt and that of the bus bar, thereby necessitating periodic readjustment of the bolt.

Although according to an aspect of the present invention, the problems outlined above are overcome by providing the module with an electrical connector assembly for connection, by means of a lead, to the circuitry of the module and which is automatically matable with the bus bar as the module is pushed home in the frame in the direction of the bus bar, the invention primarily concerns the provision of an electrical terminal adapted to form part of the said connector assembly, for connecting the circuitry of the module to said assembly and which will provide a secure electrical connection to a lead extending from the module circuitry, despite fluctuations in the temperature thereof.

The terminal provided by the invention, comprises, stated generally, a pair of plates, between which an electrical contact element connected to the lead and having a hole therethrough, can be sandwiched, with shaft components outstanding from adjacent faces of the plates, force fitted into aligned apertures in the plates, and extending through said hole in the contact element, the shaft components cooperating to form a hollow shaft through which a fastener can be passed to secure the terminal to the remainder of the electrical connector assembly.

By virtue of the forced fit between the plates, the integrity of the connection is maintained as the temperature of the module changes.

In the interest of economy in the manufacture of the terminal, the plates are preferably identical castings, the shaft component being in the form of semicircular cross-sectional segments and the plates being provided with identical means for relatively standing them off to accommodate the contact element between them.

However, the shaft components could be for example of rectangular or of any other convenient cross-sectional shape or could be more than two in number.

For mating with a bus bar, each plate is provided with a contact spring, the contact springs cooperating to provide a bus bar receptacle when the plates are in position about the contact element.

The terminal can be secured to a guide fork for guiding the said receptacle into mating relationship with the bus bar as the module is moved theretowards, the guide fork and the terminal being secured together by said fastener, and being mounted for sliding movement along a slideway for connection to the module so that the guide fork faces the bus bar and it, together with the terminal, can slide transversely of the direction of movement of the module. Thus as the guide fork engages the bus bar, the guide fork and the terminal are slidable so as to take up any lateral movement of the module with respect to the frame. Such lateral movement will usually arise because the module is mounted to rails in the frame with some lateral play, so that the module can easily be engaged with the rails and slid therealong.

For a better understanding of the invention, reference will now be made by way of example to the accompanying drawings in which.

Figure 1:
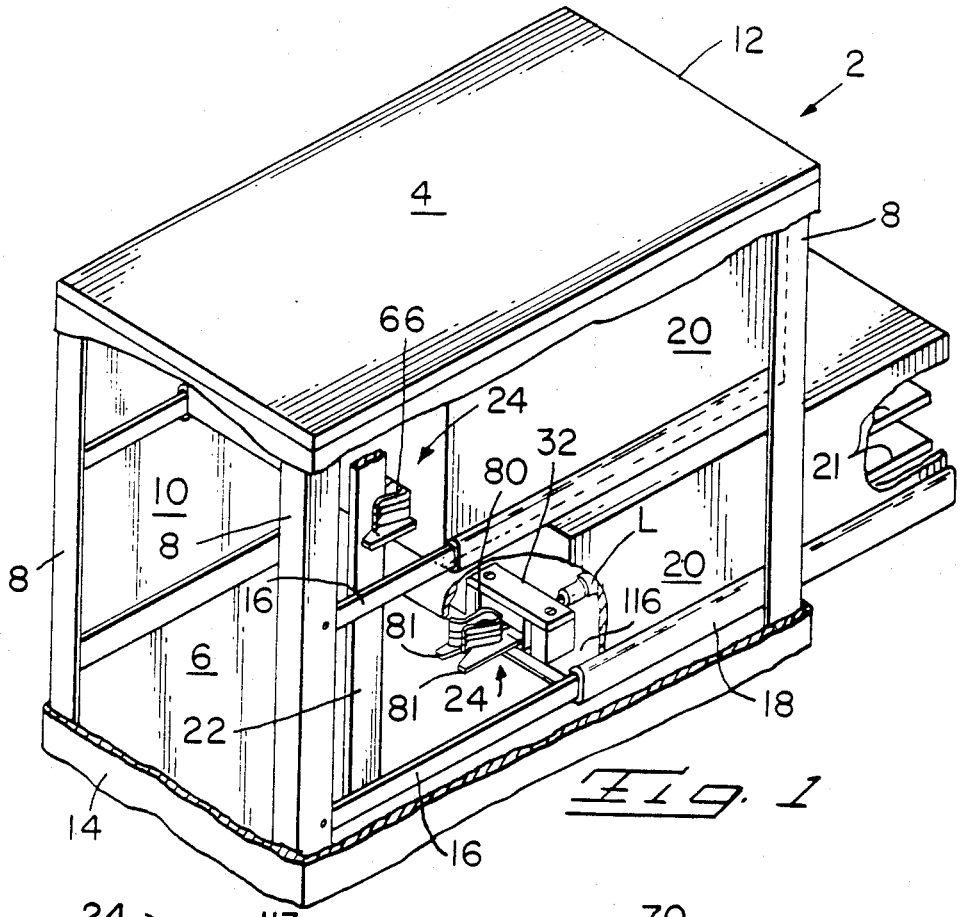
FIG. 1 is a perspective view, with parts removed of a rack frame in which electrical modules are slidable towards and away from a bus bar fixed to the frame, the modules being provided with electrical connector assemblies for mating with the bus bar.

As shown in FIG. 1, a rack frame 2, has a roof 4 and a base 6 connected by vertical uprights 8, and side walls 10 (only one of which is shown). The frame 2 has a first end 12 and a second end 14, horizontal, vertically spaced, rails 16 spanning the uprights 8 and extending between said ends. Mounted on gibs 18 engaged about the rails 16, for sliding movement towards and away from said end 14, are superposed electrical power supply modules 20 containing circuit boards 21. Proximate to the end 14 of the frame 2, is a vertical bus bar 22 which is common to the modules 20. Each module 20 has secured to its end nearest to the end 14 of the frame 2, an electrical connector assembly 24 for mating with the bus bar 22. The upper module 20 is shown in FIG. 1 in a position in which it has been advanced towards the end 14 of the frame 2 to mate its assembly 24 with the bus bar 22, the lower module 20 being shown in a position in which it is withdrawn from the end 14 of the frame 2.

Figure 3:
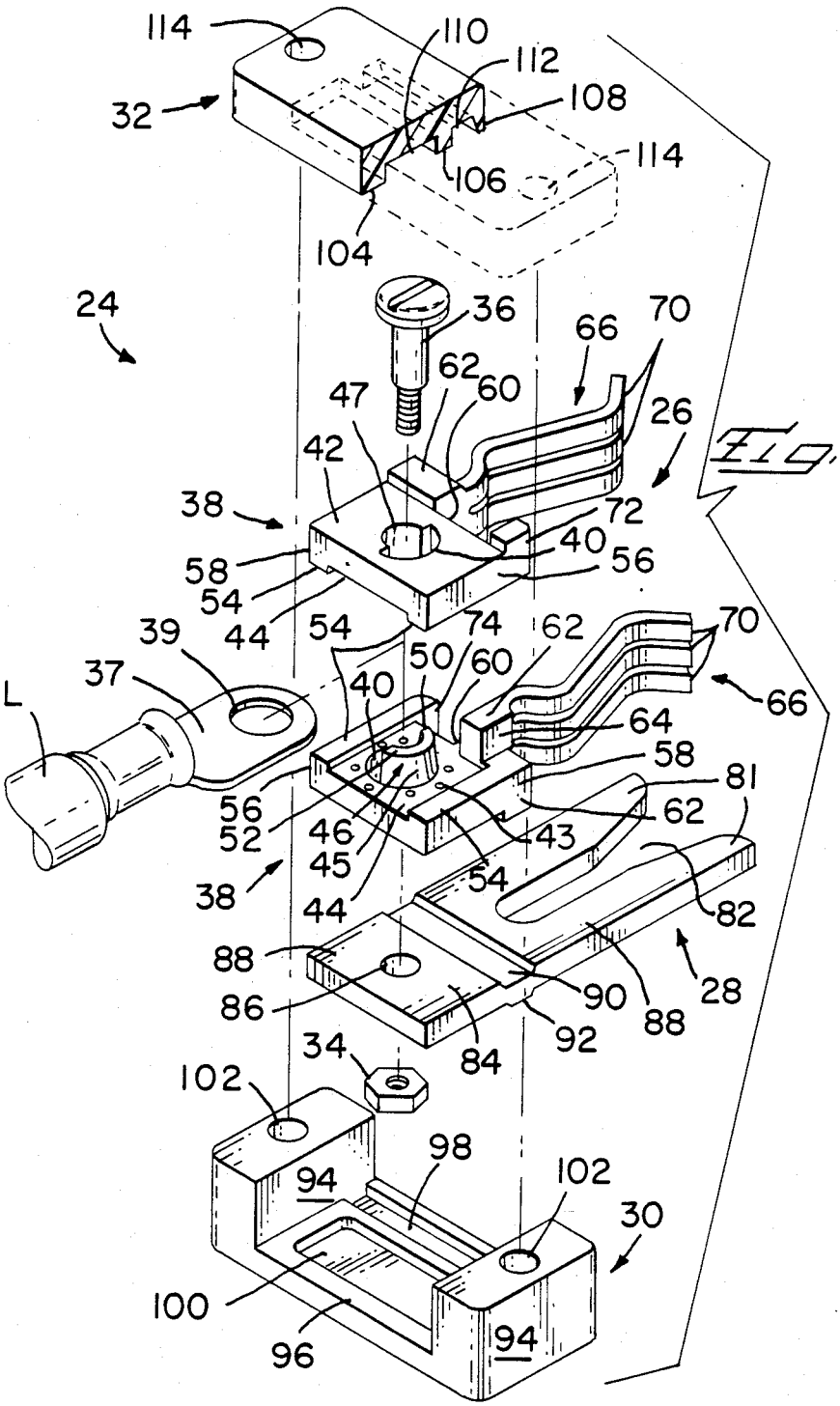
FIG. 3 is an exploded perspective view of said assembly.

As shown in FIG. 3, each assembly 24 comprises an electrical terminal 26, a guide fork 28, a slideway 30, a slideway cover 32, a fastener in the form of a nut and bolt, 34 and 36, respectively, and an electrical contact element in the form of a ring tongue 37 crimped to an electrical lead L.

Figure 4:
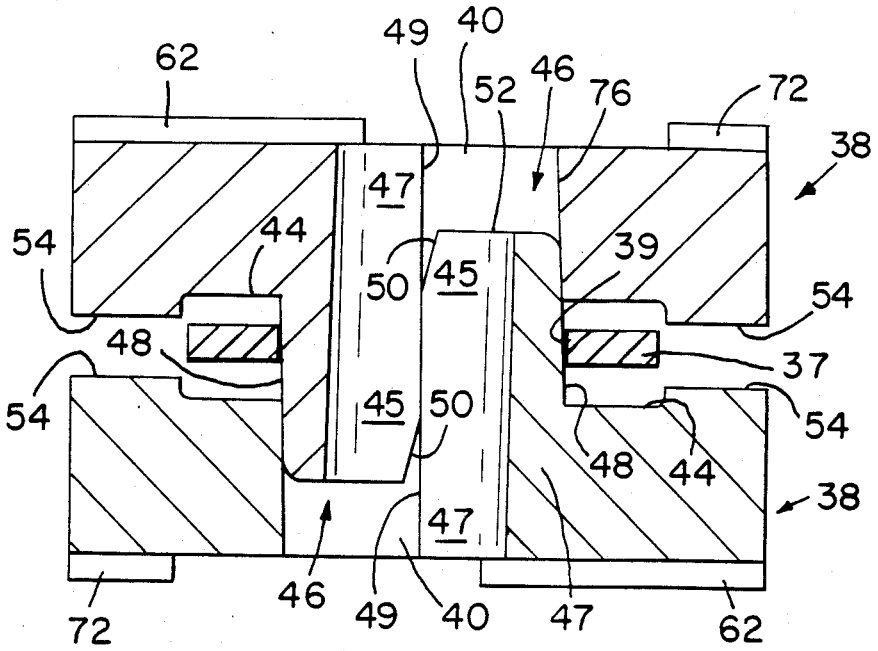
FIG. 4 is a cross-sectional view of an electrical terminal of the assembly, in a partially assembled condition.
Figure 5:
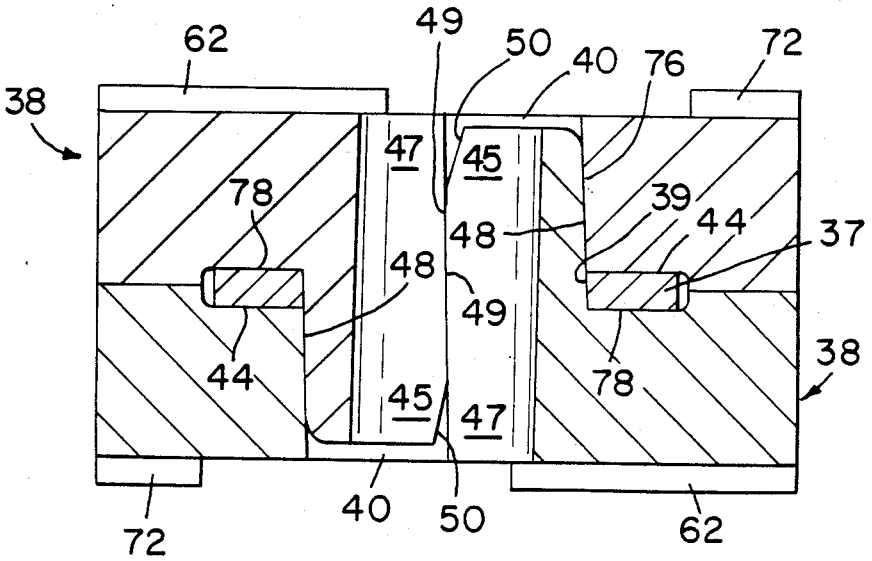
FIG. 5 is a similar view to that of FIG. 4 but showing the terminal in a fully assembled condition.

The terminal 26 comprises a pair of identical cast metal plates 38. Each plate 38 has a central through aperture 40 opening into opposite faces 42 and 44 of the plate 38. As shown in FIG. 3, the face 24 may be formed with tolerance take up bosses 43. A shaft component in the form of a semicircular cross section shaft segment 46 has a first portion 45, outstanding from the face 44 and a second portion 47 providing a segment of the periphery of the aperture 40 of the plate 38 as shown in FIGS. 4 and 5. The radially outer face 48 of the portion 45 of each shaft segment 46 tapers slightly away from the face 44. The longitudinal edges 49 of each portion 45 have chamfered surfaces 50 proximate to a free end 52 of the portion 45, which is remote from the face 44 of the plate 38. The wall 76 of each aperture 40, which wall is opposite to the portion 47 of the segment 46 tapers away from the face 44. On either side of the aperture 40, each plate 38 is formed with a standoff rudimentary wall 54 these walls extending in parallel relationship along opposite edges 56 and 58 of the plate 38. From a forward edge 60 of the plate 38, which edge is adjacent to the edges 56 and 58 thereof, there projects a contact spring base block 62 having a lateral abutment face 64, the block 62 being positioned towards one side of the aperture 40. From each block 62 extends an array 66 of superposed contact springs 70. There also projects from the edge 60, on the opposite side of the aperture 40, to the block 62, an abutment block 72 having an inner abutment face 74.

Figure 2:
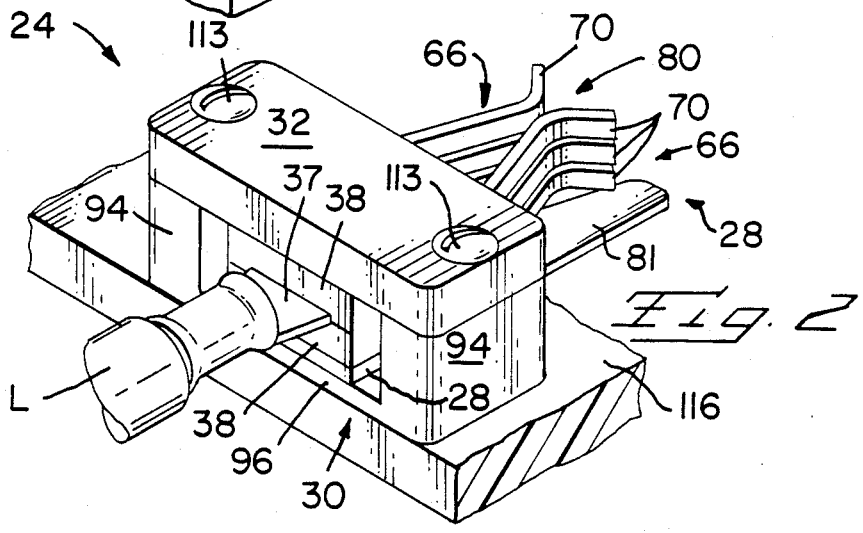
FIG. 2 is an enlarged perspective view showing one of said assemblies.

The terminal 26 is assembled to the ring tongue 37 by inserting the portion 45 of the shaft segment 46 of one of the plates 38, through the hole 39 in the ring tongue 37 and then mating the two plates 38 by inserting the portion 45 of the shaft segment 46 of one plate 38 into the aperture 40 of the other plate as shown in FIG. 4. During the mating operation, the chamfered surfaces 50 of the shaft segments 46 engage one another thereby guiding the shaft segments 46 into sliding engagement with one another along their longitudinal edges 49, so that each portion 45 is force fitted (FIG. 5), by virtue of the taper of its outer face 48, between the other shaft segment 46 and the opposite wall 76 of the aperture 40 of the other plate 38, which wall 76 is tapered complementarily with the face 48 of the one plate 38. In the fully mated or assembled position in which they are shown in FIG. 5, the two shaft segments 46 provide a hollow shaft for receiving a fastener, as described below. By virtue of the provision of the rudimentary walls 54, the ring tongue 37 is accommodated in said fully mated condition of the plates 38, in spaces 78 between the surfaces 44 of the two plates 38. The walls 54 are of such height that the ring tongue 37 is firmly engaged by between the faces 44 in full surface to surface engagement therewith. Also in the fully mated condition of the plates 38, the abutment face 74 of the block 72 of each plate 38 engages against the abutment face 64 of the block 62 of the other plate 38 thereby preventing relative rotation of the plates 38 about the apertures 40. The abutment faces 64 and 74 are shown in FIG. 3. Furthermore, in said fully mated position, the arrays 66 of contact springs 70 cooperate to define a tulip-shaped, bus bar receptacle 80, as shown in FIGS. 1 and 2. The bosses 43, where such need to be provided take-up tolerances between the terminal 26 and the ring tongue 37 so that the latter is in firm surface to surface contact with both of the faces 44.

The fork 28 has tines 81 defining a flared, receptacle guiding mouth 82, the tines 81 extending from a guide fork support plate 84 provided with a fastener receiving through hole 86, the plate 84 having in one face 88 thereof a transverse groove 90 and in the opposite face thereof a transverse rib 92 coterminous with the groove 90.

As best seen in FIG. 3, the slideway 30 comprises a pair of spaced cheeks 94 connected by a web 96 having a slideway groove 98 extending between the cheeks 94 and being formed with a nut receiving opening 100 beside the groove 98. Each cheek 94 has a vertical, opening 102.

The cover 32 has on its underside, ribs 104, 106 and 108 defining slideway grooves 110 and 112.

The terminal 26 having been assembled to the ring tongue 37 as described above, the terminal 26 is assembled to the fork 28 by inserting the parts of the blocks 62 and 72 which project below the surface 42 of the lower plate 38 into the groove 90 in the fork 28, passing the screw 36 through the said hollow shaft provided by the shaft segments 46 of the plates 38, and the opening 86 of the fork 28 and screwing the nut 34 home on the screw 36 to connect together the terminal 26 and the fork 28 in superposed, fixed relationship. The rib 92 of the fork 28 is then inserted into the groove 98 of the web 96, of the slide way 30, the nut 34 being received in the opening 100 of the web 96 and the cover 32 is placed on the cheeks 94 so that the parts of the blocks 62 and 72 projecting from the face 42 of the upper plate 38 are received in the groove 108 of the cover 32, the head of the screw 36 being received in the groove 110 of the cover 32. Screws 113 (FIG. 2) are then passed through holes 114 in the cover 32 and the openings 102 in the cheeks 94 and are screwed into tapped holes (not shown) in a base plate 116 of the corresponding module 20 so that the connector assembly 24 assembled as shown in FIG. 2 is secured to the plate 116.

In this assembled condition of the assembly 24, the tines 81 of the fork 28 project beyond the free ends of the contact springs 70 of the array 66, towards the bus bar 22, as shown in FIG. 1. In order to connect the module 20 to the bus bar 22, the former is slid along the respective rails 16, towards the end 14 of the frame 2 so that the bus bar 22 is received in the mouth 82 of the fork 28, despite play between the rails 16 and the corresponding gibs 18, so that the receptacle 80 is guided with respect to the bus bar 22, whereby the later is received between the arrays 66 of contact springs 70, as shown in respect of the upper module 20, in FIG. 1, as the module 20 reaches its home position in the frame 2. Each module 20 can thus be rapidly connected to the bus bar 22, damage to the receptacle 80 or to the bus bar 22, being avoided by reason of the guiding action of the fork 28 and the slidability of the connector 26 and fork 28 lengthwise of the slideway groove 98 of the slideway 30.

The portions of the block 62 and of the block 72, which are received in the slideway groove 112 of the cover 32, and the head of the bolt 36 which is received in the slideway groove 110 of the cover 32 are slidable along these slideways, the nut 34 being movable along the opening 100 in the web 96. The connector 26 and the fork 28 which is fixed thereto are accordingly free to slide at right angles to the rails 16, to an extent limited by the cheeks 94 of the slideway 30.

By virtue of the forced fit between the two plates 38, the integrity of the connection between the ring tongue 37 and the terminal 26, is undisturbed by temperature fluctuations.

The ring tongue 37 may be formed with bosses similar to the bosses 43 and for the same purpose, and/or the ring tongue 37 may be made in the form of an arcuate cross section lock washer.

We claim:

1. A bipartite electrical terminal for making electrical connection to an electrical contact element having a hole therethrough, the terminal comprising a pair of metal plates each provided with a through aperture opening into opposite faces of said plate and with a shaft segment comprising a first portion outstanding from one of said opposite faces of said plate and having a free end remote therefrom and a second portion forming a segment of the periphery of the aperture in said plate, the first portion of each shaft segment being capable of being force fitted into the aperture of the other plate, with said first portions of said segments extending through the hole in said contact element, whereby said segments cooperate to provide a hollow shaft for receiving a fastener therethrough and the plates are retained in superposed relationship about said contact element.

2. A terminal as claimed in claim 1, wherein the shaft segment of each plate is of semicircular cross section and is formed integrally with said plate, said plates being identical with each other.

3. A terminal as claimed in claim 1, wherein said one opposite face of each plate is provided with means for standing it off from the other plate to accommodate said contact element in surface-to-surface contact with both of said opposite faces, when said first portions of said shaft segments have been fully inserted into said apertures.

4. A terminal according to claim 3, wherein said standoff means comprise spaced, rudimentary walls extending along opposite edges of said one opposite face of each plate.

5. A terminal as claimed in claim 1, wherein the outer face of the first portion of each shaft segment is tapered in a direction away from said one opposite face, the remainder of the periphery of said aperture tapering towards said opposite face and the free longitudinal edges of said first portion being chamfered at the free ends thereof.

6. A terminal as claimed in claim 1, wherein each plate is provided with a contact spring having a base projecting from an edge of the plate on one side of the aperture therein and a lug projecting from said edge on the other side of said aperture, the lug of one plate engaging against the base of the contact spring of the other plate and said contact springs cooperating to provide an electrical receptacle, when said first portions of said shaft segments have been fully inserted into said apertures.

7. A terminal as claimed in claim 1, further comprising resilient means for taking up tolerances between the plates and the contact element to ensure that the latter is in surface to surface contact with both of said opposite faces when the shaft segments have been fully inserted into said apertures.

8. A bipartite electrical terminal for making electrical connection to a ring tongue, the terminal comprising a pair of metal plates, each plate being formed with a through aperture opening into opposite faces of said plate and with a semicircular cross section shaft segment comprising a first portion outstanding from one of said faces of said plate and having a chamfered free end remote therefrom and a second portion providing a segment of the periphery of the aperture in said plate, the radially outer face of each said first portion tapering towards said free end thereof and the remainder of the periphery of said aperture being tapered complimentarily with the taper of said radially outer face, the first portion of each shaft segment being insertable into the aperture of the other plate, with the ring tongue surrounding said first portions, and each first portion being guided into force fitting relationship into the aperture of the other plate by cooperation between the chamfered free ends of said first portions, so that said shaft segments cooperate to provide a shaft extending through said plates.

9. A terminal as claimed in claim 8, wherein each plate is provided with stand-off means comprising a pair of parallel, spaced, rudimentary walls extending along opposite edges of said one opposite face of the plate.

10. A terminal as claimed in claim 8, wherein each plate, which is rectangular, is provided with a contact spring extending from an edge of the plate, the contact springs cooperating to provide an electrical receptacle when the shaft segments have been fully inserted into the apertures.

11. A terminal as claimed in claim 8, wherein the plates are identical, each plate being in the form of a one-piece casting.

12. An electrical connector assembly for making an electrical connection to a bus bar, the assembly comprising:

a bipartite electrical terminal comprising a pair of metal plates, each plate having a through aperture opening into opposite faces thereof, a shaft component projecting from one of said opposite faces in alignment with a corresponding part of said aperture, each shaft component having been inserted into the aperture of the other plate in force fitting relationship so that the shaft components cooperate to provide a hollow shaft, contact springs projecting from said plates, cooperating to provide a bus bar receptacle projecting from coincident edges of the plates;

an electrical contact element connected to a lead extending about said shaft components and being sandwiched between said plates;

a receptacle guide fork having a receptacle guiding mouth for guiding a bus bar between the contact springs, the fork extending parallel to said plates and having one side facing theretowards, the other side of the fork having a rib extending at right angles to the tines of the fork, a through hole being provided in the fork in alignment with the apertures in said plates;

a slideway, slidably receiving said rib for limited movement in a direction at right angles to said tines;

a fastener extending through said shaft and said apertures in said plates and said hole in the fork, to retain said terminal and said fork in fixed superposed relationship; and means for securing said terminal and said fork to said slideway for sliding movement relative thereto.

13. An assembly as claimed in claim 11, wherein a cheek is provided at each end of said slideway to limit the movement of said terminal and said fork therealong, the retaining means comprising a cover secured to said cheeks and being slidably engaged by said terminal.

14. A bipartite electrical terminal for making electrical connection to an electrical contact element having a hole therethrough, the terminal comprising a pair of metal plates each provided with a through aperture opening into opposite faces of said plate and with a shaft component comprising a first portion outstanding from one of said opposite faces of said plate and having a free end remote therefrom and a second portion forming a part of the periphery of the aperture in said plate, the first portion of each shaft component being capable of being force fitted into the aperture of the other plate, with said first portions of said shaft components extending through the hole in said contact element, whereby said segments cooperate to provide a hollow shaft for receiving a fastener therethrough and the plates are retained in superposed relationship about said contact element.

15. A terminal as claimed in claim 14, wherein the outer face of said first portion of each shaft segment is tapered in a direction away from said one opposite face, the remainder of the periphery of said aperture tapering in a direction towards said opposite face and the free longitudinal edges of said first portion being chamfered at the free end thereof.

* * * * *